US005204995A

United States Patent [19]

Knapp

[11] Patent Number: 5,204,995

[45] Date of Patent: Apr. 27, 1993

[54] FASHIONABLE REVERSIBLE PANTS

[75] Inventor: Dawn P. Knapp, Yorba Linda, Calif.

[73] Assignee: Creative Garments, Inc., Los Angeles, Calif.

[21] Appl. No.: 851,578

[22] Filed: Mar. 16, 1992

[51] Int. Cl.[5] ..... A41D 1/06

[52] U.S. Cl. ..... 2/228; 2/227; 2/211; 2/247; 2/79; 2/234; 2/235; 2/DIG. 2

[58] Field of Search ..... 2/228, 227, 211, 247, 2/DIG. 2, 79, 234, 235

[56] References Cited

U.S. PATENT DOCUMENTS

| | | | |
|---|---|---|---|
| 1,337,698 | 4/1920 | Gongora | 2/227 |
| 2,696,617 | 12/1954 | Worchester . | |
| 2,711,539 | 6/1955 | Loscher . | |
| 2,759,192 | 8/1956 | Levi . | |
| 3,234,564 | 2/1966 | Chujfi | 2/79 |
| 3,425,062 | 2/1969 | Chujfi | 2/79 |
| 5,063,614 | 11/1991 | McSheffery . | |

*Primary Examiner*—Clifford D. Crowder
*Assistant Examiner*—Gloria Hale
*Attorney, Agent, or Firm*—Poms, Smith, Lande & Rose

[57] ABSTRACT

A pair of reversible pants with a reversible front pocket arrangement and/or a reversible button fly arrangement is disclosed. The reversible pocket arrangement includes a pocket slot defined in the pants corresponding to a desired upper edge of each pocket, and a pocket flap corresponding to each pocket. The flap is attached to the pants and can extend down through the corresponding pocket slot so as to contact either surface of the pants. The flap has a first surface and an opposing second surface, with a first pouch formed on the flap first surface and a second pouch formed on the flap second surface. The reversible fly arrangement includes a first fly panel and a second fly panel, each having buttonholes that align when the two panels overlap. Double stud buttons, formed of two stud portions interconnected by a narrow neck portion, are passed through the buttonholes so as to secure the first panel to the second panel when the garment is being worn, and further wherein one stud portions of each of the double stud buttons is visible when the pants are worn with either the first surface or the second surface facing out.

20 Claims, 2 Drawing Sheets

FIG. 1
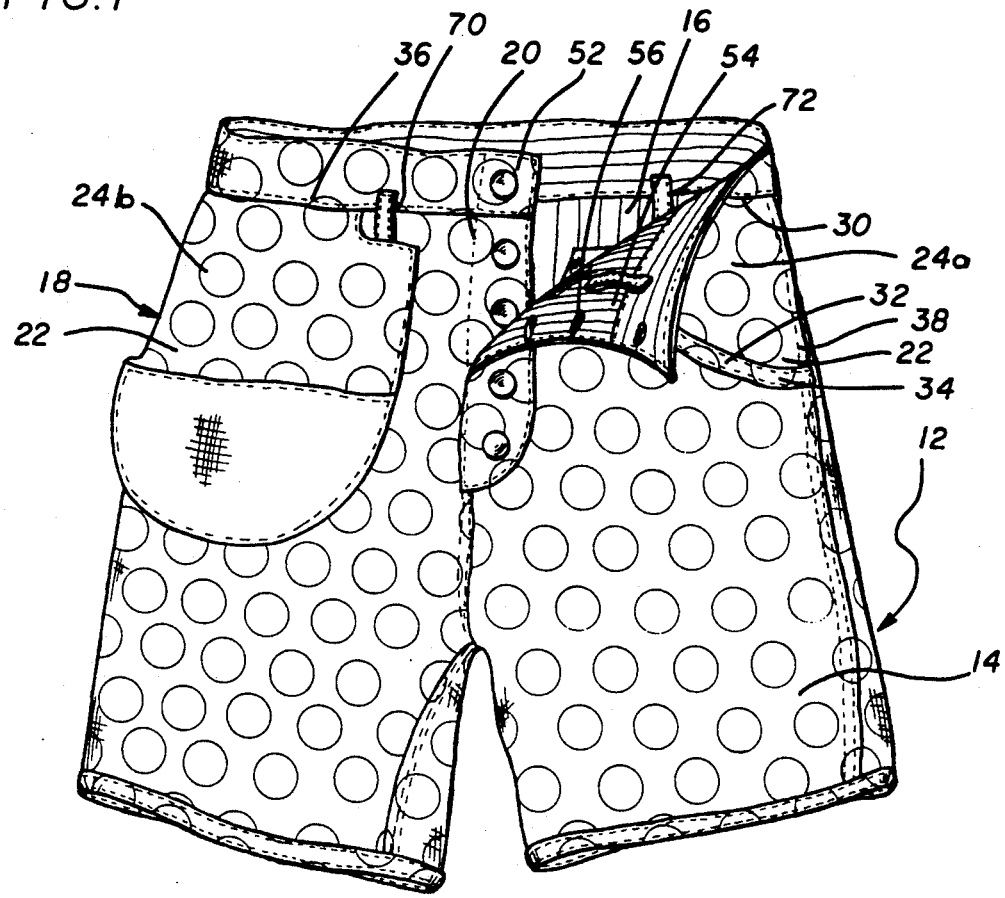
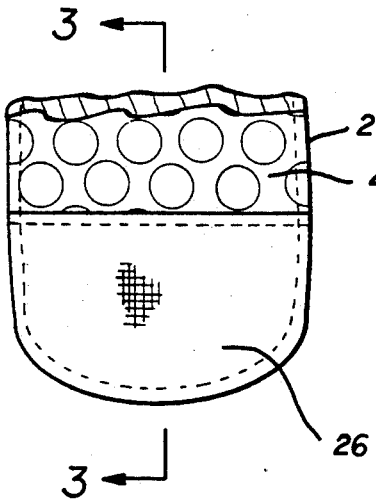
FIG. 2
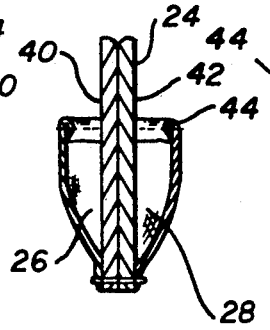
FIG. 3
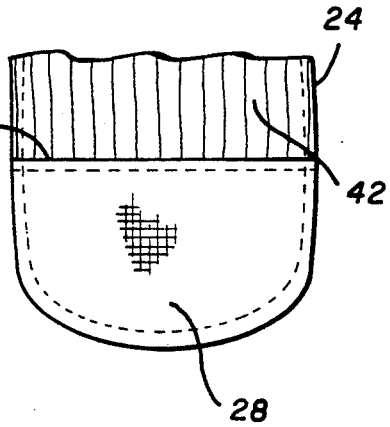
FIG. 4

FASHIONABLE REVERSIBLE PANTS

1. FIELD OF INVENTION

This invention relates to a pair of reversible pants, such as shorts or slacks, and more particularly to pair of reversible pants having a reversible front pocket arrangement and/or a reversible button fly arrangement.

2. BACKGROUND OF INVENTION

Reversible clothing is known in the art. Reversible garments are designed such that the two surfaces of the garment have a different pattern, color, or texture. Therefore, the user is provided with two choices of pattern, color or fabric texture with each garment.

Some types of reversible garments are constructed using two different types of fabrics. The two fabrics are sewn together such that a different fabric faces out when the garment is turned inside out and vice versa. The problem with this design is that the clothing is typically bulky and uncomfortable due to the two layer thickness of the garment fabric. In order to solve this problem, reversible garments were designed using two-sided, single thickness fabric. Because the fabric is only one layer in thickness, the garment is relatively thin and comfortable to wear, yet the garment is reversible.

However the design of pockets and fly openings for pants still creates a problem when two sided fabric is used. With most designs of pockets and fly openings, the structural appearance and form of the pockets and the fly changes when the pants are reversed. In order to solve this problem with the pockets, several types of reversible pants with reversible pockets were designed. For example, U.S. Pat. Nos. 3,425,062 and 3,234,564, issued to Chujfi disclose a pair of reversible pants wherein the front panels have pockets sewn to each surface. Therefore, when the pants are worn with either side out, a pair of front pockets are useable to the wearer. However, due to the triple thickness caused by the double pockets, the front pocket area of the pants is relatively thick and bulky.

Another pair of reversible pants with reversible pockets is disclosed in U.S. Pat. No. 1,337,698, issued to Gongora. Gongora discloses a pocket arrangement in which the pocket is secured to the front panel of the pants, and passes through a slot in the front panel of the pants to either side of the pants. However, in the pocket arrangement disclosed in Gongora, only the top portion of the pocket is secured the front panel of the pants. As a result, the lower end of the pockets can easily bunch when the pants are worn. Also, the pockets may pull at the area where the pockets are secured to the pants when relatively heavy items are placed in the pockets. The need to access the single pocket of Gongora from both sides weakens the structural continuity of the garment; and the Gongora pants therefore includes two wide bands, one on each side of the upper opening of each pocket, with the result that the Gongora pants have at least one bulky transverse zone where there are five thicknesses of material. Therefore, a need exists for a pair of reversible pants having a reversible pocket arrangement, wherein the pants have adequate structural continuity without unduly bulky zones, and wherein the pockets are provided with adequate support to prevents the pockets from bunching or pulling.

The reversible pants known in the art are also typically designed with either zipper or button flys. For example, the reversible pants disclosed in the Gongora patent use buttons and buttonholes to close the fly. The buttons are on the inner flap of the fly, such that when the pants are worn normal side out, the buttons are facing away from the body, and are visible. When the pants are turned inside out, the buttons are facing toward the body, and are hidden from view. As a result, the fly is buttoned and unbuttoned differently depending on how the pants are worn, and the fly is more difficult to unbutton when the pants are worn inside out. Also, when the pants are worn inside out, the structural appearance of the fly differs from when the pants are worn right side out Therefore, a need exists for a pair of reversible pants having reversible front pockets with adequate support, wherein the fly is easily buttoned or unbuttoned when the pants are worn with either side facing out, and wherein the structural appearance and function of the front pockets and the fly does not change depending on which side of the pants are worn facing out.

3. SUMMARY OF INVENTION

One object of the present invention is to provide a pair of reversible pants wherein the front pockets are reversible so as to function with either surface of the pants facing out.

Another object of the present invention is to provide a reversible pair of pants having a fly opening that is buttoned open and closed in the normal manner with the buttons facing outward when either surface of the pants faces out.

A still further object of the invention is to provide a reversible pair of pants wherein the structural form, appearance and function is the same with either surface facing out.

Yet another object of this invention is to provide a reversible pair of pants having a fabric thickness of a normal one-sided pair of pants.

Still another object of this invention is to provide a reversible pair of pants wherein the front pockets are well-supported.

A further object of this invention is to provide a reversible pair of pants having a rear patch pocket on both surfaces of the pants.

These and other objects of the present invention are achieved through a reversible pair of pants having a first fabric surface of one appearance and a second fabric surface of a different appearance and having the same structural appearance, form, and function with either side facing out. The pants include a reversible front pocket configuration wherein a reversible pocket flap having pouches defined on both sides can swing through a slot in the front panel of the pants to either surface of the pants.

More specifically, one illustrative embodiment of the reversible pants may include a pocket flap corresponding to each of the pockets, the flap being attached to the pants and extending down through each corresponding pocket slot, the flap having first and second surfaces matching the exposed fabric surfaces of the pants, a pocket slot defined in the pants corresponding to the desired upper edge of each pocket, a first pouch formed on the flap first surface, a second pouch formed on the flap second surface, a fly opening comprising a first panel and a second panel, wherein the first panel and second panel define a plurality of buttonholes, the buttonholes on the first panel being aligned with the buttonholes on the second panel, a plurality of double stud buttons, each of the buttons including a first and a second stud portion interconnected by a narrow neck portion, the buttons passing through the button holes so as to secure the first panel to the second panel when the garment is being worn, and further wherein one stud portion of each of the double stud buttons is visible when the pants are worn with either the first surface or the second surface facing out, and the first and second stud portions of each button being of a size to pass through an adjacent buttonhole; whereby with either orientation of the reversible pants, the fly may be buttoned and unbuttoned in a normal manner with the outer stud portion of each button passing through a corresponding outer buttonhole.

In accordance with one feature of the invention, the reversible fly may include aligned button holes on the two overlapping edges of cloth in the fly area of the pants, and double stud buttons which may be buttoned through the outer button holes with either side of the reversible pants facing outward.

The pants of the present invention are fashionable, good looking and comfortable, as the over-all appearance (apart from the different outer surface configuration) is substantially the same with either side out, and the pants have good structural integrity throughout, with no bulky or uncomfortable areas in the pants resulting from the reversibility.

These and other objects features and advantages of the present invention will now become apparent from a review of the drawings and the following description of the preferred embodiments.

4. BRIEF DESCRIPTION OF THE DRAWINGS

FIG. 1 is a front view of a pair of reversible pants illustrating the principles of the present invention with the first surface facing out and one pocket pulled out to show its construction;

FIG. 2 is a front view of the reversible pocket flap of FIG. 1 showing the first surface of the pocket flap;

FIG. 3 is a side cross-sectional view of the reversible pocket flap taken along line 3—3 of FIG. 2;

FIG. 4 is a rear view of the reversible pocket flap of FIGS. 2 and 3 showing the second surface of the pocket flap;

5. DETAILED DESCRIPTION

Figure 5:
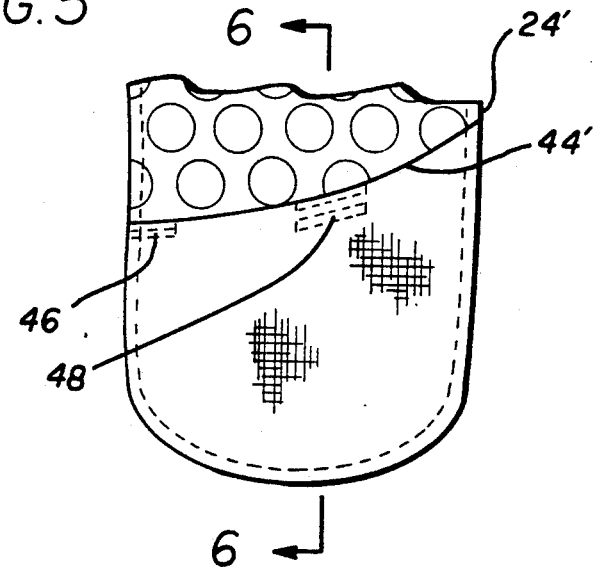
FIG. 5 is a front view of an alternate embodiment of a reversible pocket flap illustrating the principles of the present invention.

Referring now to FIG. 1, a first embodiment of a reversible pair of pants 12 is shown. The reversible pants 12 include a first pants surface 14 and a second pants surface 16. The first pants surface 14 and second pants surface 16 preferably have different appearances in color, pattern or texture. The fabric used to construct the reversible pants 12 preferably consists of two-sided fabric with each surface of the fabric having a different color, pattern or texture. FIG. 1 shows the pants 12 with the first pants surface 14 facing out. The reversible pants 12 include a reversible front pocket arrangement 18 and a reversible fly arrangement 20.

In the preferred embodiment, the reversible front pocket arrangement 18 is used for two front pockets 22. Each of the pockets 22 is comprised of a pocket flap 24, a first pouch 26, and a second pouch 28 (shown in FIGS. 3 and 4). As shown in FIG. 1, the pants 12 include a pair of front panels 30, which define two pocket slots 32. The pocket slots 32 correspond to a desired upper edge 34 of the pockets 22. The pocket flap 24 is attached to the pants 12, and extends down through the corresponding pocket slot 32. The pocket flap 24 is preferably attached to the pants 12 along a portion of the waistband 36 and a portion of the side seam 38 of the pants 12. The attachment of the pocket flap 24 to both the waistband and the side seam provides support to the pocket 22 and precludes undesired bunching or pulling of the pocket. Once the pocket flap 24 is attached to the pants 12, the user can insert his hand through the slot 32, and into an appropriate one of the pouches 26,28 on the flap 24. Incidentally the pouches 26,28 may be made of somewhat lighter material than the main fabric of the pants, as is customary for pockets of conventional pants to avoid unnecessary bulkiness.

In FIG. 1, one of the pocket flaps 24 is properly inserted down into the pocket slot while the other pocket flap designated 24*b* to the left as viewed in FIG. 1 is shown exposed so that the construction may be more readily understood.

The attachment of the pocket flaps 24 to the portion of the waistband 36 and portion of the side seam 38 allows the pocket flaps 24 to swing through the slot 32 so as to rest against the pants first surface 14 or the pants second surface 16. Still referring to FIG. 1, the right pocket flap 24*a* is shown next to the pants second surface 16, and the left pocket flap 24*b* is shown against the first pants surface 14.

Referring now to FIGS. 2, 3, and 4, the pocket flap 24 is shown in detail. More specifically, the pocket flap 24 includes the first pouch 26, which is formed on a first surface 40 of the pocket flap 24, and the second pouch 28, which is formed on a second surface 42 of the pocket flap 24. Preferably, the pocket flap first surface 40 matches the first pants surface 14, and the pocket flap second surface 42 matches the second pants surface 16. The exposed portions of the pocket flaps 24 then match the exposed surface of the pants 12 when the pants are worn with either surface facing out.

In use, when the pants 12 are worn with the pants first surface 14 facing out, the pocket flaps 24 are passed through the slots 32 such that the pocket flap first surfaces 40 contact the pants second surface 16. The user can then insert his hand through the slot 32, and into the pocket flap first pouch 26. When the pants are turned inside out, or are reversed, such that the pants second surface 16 is facing out, the pocket flaps 24 are passed through the slots 32 so that the pocket flap second surfaces 42 contact the pants first surface 14. The user can then insert his hand through the slot 32, and into the second pouch 28 on the pocket flap 24.

Figure 6:
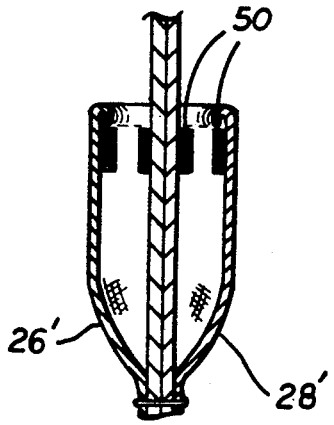
FIG. 6 is a side cross-sectional view of the alternate embodiment of the reversible pocket flap taken along line 6—6 of FIG. 5.

Referring now to FIGS. 5 and 6, an alternate pocket flap 24' is shown in detail. In this alternate embodiment, the upper edges 44' of the pouches 26', 28' are approximately aligned with or just below the upper edges of the pockets 22, and approximate the curve of the slots 32. To preclude items from falling out of the pouches 26', 28', the pouches upper edge 44' may be secured to the flap 24 along a first portion 46 of the pouch upper edge 44' toward the rear of the pants. The pouch upper edge upper edge 44' may also be releasably attached to the flap 24' at a second portion 48 of the pouch upper edge 44' in order to avoid items from falling out of the pocket pouch 26', 28'. The means for releasably attaching the second portion 48 of the pouch to the flap 24' may comprise mating thin strips 50 of VELCRO type hook and loop material, mating buttons and buttonholes, or mating snaps.

Figure 7:
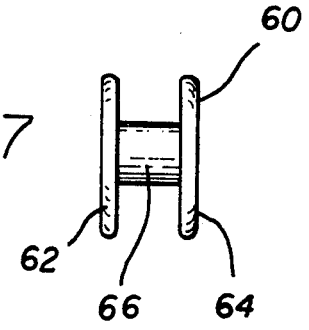
FIG. 7 is a side view of the double stud button of the reversible pants of FIG. 1.
Figure 8:
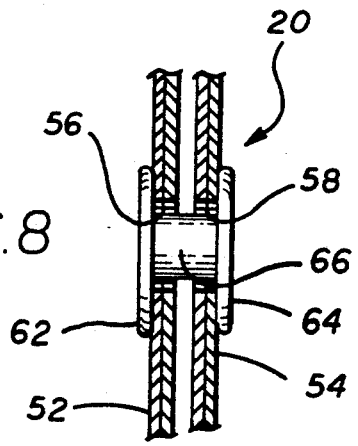
FIG. 8 is a side cross-sectional view of the reversible fly with a double stud button inserted through the aligned buttonholes.

Referring now to FIGS. 7 and 8, the reversible fly arrangement 20 of the present invention is shown in detail. The reversible fly arrangement 20 includes a first panel 52 and an overlapping second panel 54. The first panel 52 includes a first plurality of buttonholes 56, and the second panel 54 includes a second plurality of buttonholes 58. The first buttonholes 56 and second buttonholes 58 are aligned when the first panel 52 and the second panel 54 are overlapped. The reversible fly arrangement 20 further include a plurality of double stud buttons 60. The double stud buttons 60, best shown in FIG. 7, include a first stud portion 62, a second stud portion 64, and a narrow neck portion 66 connecting the first and second stud portions 62, 64.

To secure the fly closed, the first and second panels 52, 54 are overlapped with the corresponding buttonholes 56, 58 in an aligned position. The first stud portion 62 of the double stud button 60 is then passed through the aligned buttonholes 56, 58 such that one of the stud portions 62, 64 is visible from both the first surface 14 and the second surface 16 of the pants 12. One feature of the double stud buttons 60 is that the buttonholes 56, 58 on either the first panel 52 or the second panel 54 may be unbuttoned, whichever is outside, with the double stud button 60 remaining in the buttonhole of the opposite (inner) panel. Therefore, the pants may be buttoned and unbuttoned in the same normal manner whether the pants are worn with the first surface 14 facing out or the pants second surface 16 facing out.

Figure 9:
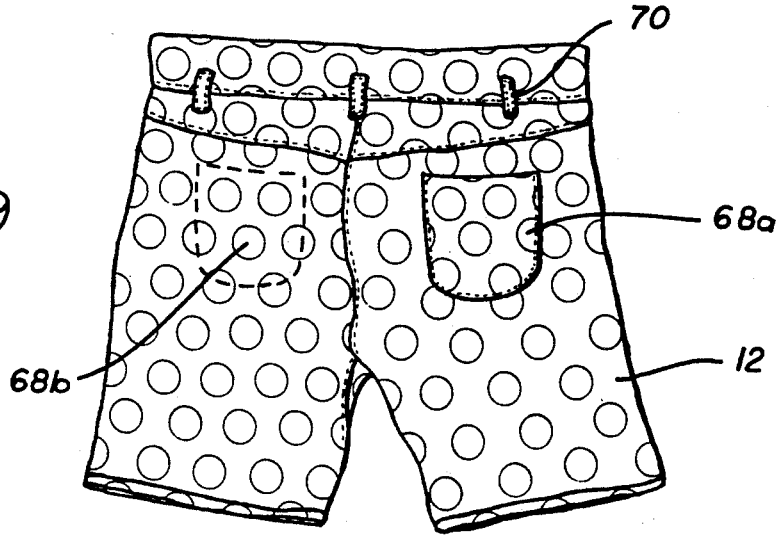
FIG. 9 is a rear view of the reversible pants of the present invention.

Referring now to FIG. 9, the arrangement of two rear patch pockets 68 is shown. The pants first surface 14 has a first one 68*a* of the patch pockets 68 secured to one half of the rear of the pants 12. The pants second surface 16 has a second one 68*b* of the patch pockets 68 secured to the opposite half of the rear of the pants 12. Therefore, neither half of the rear of the pants has a double thickness pocket, yet each of the pants surfaces includes one of the rear patch pockets 68.

Referring back to FIG. 1, the pants 12 also include a first set of belt loops 70 and a second set of belt loops 72. The first set of belt loops 70 are secured to the first pants surface 14, and preferably match the first pants surface 14. The second set of belt loops 72 are secured to the second pants surface 16, and preferably match the pants second surface 16.

Having thus described exemplary embodiments of the present invention, it should be noted by those skilled in the art that the within disclosures are exemplary only and that various other alternatives, adaptations and modifications may be made within the scope of the invention. Thus by way of example, but not of limitation, the pants may be either shorts or slacks. Also, the pants may include other patch pockets on other areas of the pants. The cloth of the reversible pants may be either a single layer of material with different patterns or colors on the two sides, or may be a double layer of material to provide different textures as well as different colors or patterns. Further, the studs may have stud end portions of different dimensions, colors or configurations, as long as the stud end portions are capable of being buttoned through the adjacent button holes. If desired, the fly areas of the reversible pants may be provided with an additional flap on both sides to conceal the stud buttons. Accordingly, it is to be understood that the present invention is not limited to the precise construction as shown in the drawings and described hereinabove.

I claim:

1. A reversible pair of pants with reversible pockets comprising:
   - a pair of pants having a first surface having one configuration or appearance and a second surface having another configuration or appearance;
   - a pocket slot defined in the pants corresponding to a desired upper edge of each pocket;
   - a pocket flap corresponding to each of the pockets, the flap being attached to the pants and extending down through each corresponding pocket slot, said flap having a first surface and an opposing second surface;
   - a first pouch formed on the flap first surface; and
   - a second pouch formed on the flap second surface.

2. A reversible pair of pants in accordance with claim 1 wherein the first surface and the second surface of the pocket flap matches the appearances of the corresponding first surface and second surface of the pants.

3. A reversible pair of pants in accordance with claim 1 wherein an upper edge of the first pouch and the second pouch extends to approximately an upper edge of the pocket.

4. A reversible pair of pants in accordance with claim 1 wherein a portion of each of the upper edge of the first pouch and the second pouch is secured to the flap toward the rear of the pants.

5. A reversible pair of pants in accordance with claim 1 wherein the front and the second pouch further include means for releasably securing a second portion of the upper edge of the pouch to the flap.

6. A reversible pair of pants in accordance with claim 1 wherein each of the pocket flaps is secured to the pants along a portion of a waistband of the pants and along a portion of a side seam of the pants.

7. A reversible pair of pants in accordance with claim 1 further comprising a first surface rear patch pocket and a second surface rear patch pocket, the first and second surface patch pockets being located on different halves of a rear side of the pants.

8. A reversible pair of pants in accordance with claim 1 wherein the first and second surfaces of the pants are formed on opposing sides of a single thickness of fabric.

9. A reversible pair of pants with reversible front pockets having a first side of one configuration and a second side of a different configuration and having the same structural form appearance and function with either side out, said reversible pants comprising:
   - a pocket slot defined in the pants corresponding to a desired upper edge of each of the front pockets;
   - a pocket flap corresponding to each of the pockets, the flap being attached to the pants and extending down through each corresponding pocket slot, said flap having first and second surfaces matching exposed surfaces of said pants;
   - a first pouch formed on the flap first surface;
   - a second pouch formed on the flap second surface;
   - a fly opening, the fly opening comprising a first panel and a second panel, wherein the first panel and second panel define a plurality of buttonholes, the buttonholes on the first panel being aligned with the buttonholes on the second panel;

a plurality of double stud buttons, each of said buttons including a first and a second stud portion interconnected by a narrow neck portion, said buttons passing through the buttonholes so as to secure the first panel to the second panel when the garment is being worn, and further wherein one stud portion of each of the double stud buttons is visible when the pants are worn with either the first surface or the second surface facing out; and said first and second stud portions of each button being of a size to pass through an adjacent button hole; whereby with either orientation of said reversible pants, the fly may be buttoned and unbuttoned in a normal manner with the outer stud portions of each button passing through a corresponding outer buttonhole.

10. A reversible pair of pants in accordance with claim 9 wherein the pocket flap is secured to the pants along a portion of a waistband of the pants, and along a portion of the side seam of the pants.

11. A reversible pair of pants in accordance with claim 9 further comprising a first surface rear patch pocket and a second surface rear patch pocket, the first and second surface patch pockets being located on different halves of a rear side of the pants.

12. A reversible pair of pants in accordance with claim 9 wherein an upper edge of the first pouch and the second pouch extends to approximately an upper edge of the pocket.

13. A reversible pair of pants comprising:

a pair of pants having a first surface having one configuration or appearance and a second surface having another configuration or appearance;

a fly opening, the fly opening comprising a first panel and a second panel, wherein the first panel and second panel define a plurality of buttonholes, the buttonholes on the first panel being aligned with the buttonholes on the second panel;

a plurality of double stud buttons, each of said buttons including a first and a second stud portion interconnected by a narrow neck portion, said buttons passing through the buttonholes so as to secure the first panel to the second panel when the garment is being worn, and further wherein one stud portion of each of the double stud buttons faces outward when the pants are worn with either the first surface or the second surface facing out; and said first and second stud portions of each button being of a size to pass through an adjacent buttonhole, whereby with either orientation of said reversible pants, the fly may be buttoned and unbuttoned in a normal manner with the outer stud portion of each button passing through a corresponding outer buttonhole.

14. A pair of reversible pants in accordance with claim 13 wherein the pants further comprise two front pockets, each of the front pockets having a pocket configuration comprising:

a pocket slot defined in the pants corresponding to a desired upper edge of the pocket;

a pocket flap attached to the pants and extending down through the corresponding pocket slot, the pocket flap having a first pouch formed on a first surface and a second pouch formed on an opposing second surface.

15. A reversible pair of pants in accordance with claim 14 wherein the first surface and the second surface of the pocket flap matches the appearances of the corresponding first surface and second surface of the pants.

16. A reversible pair of pants in accordance with claim 14 wherein an upper edge of the first pouch and second pouch extends to approximately an upper edge of the pocket.

17. A reversible pair of pants in accordance with claim 14 wherein a first portion of the upper edge of the first pouch and the second pouch is secured to the flap.

18. A reversible pair of pants in accordance with claim 14 wherein the front and the second pouch further include means for releasably securing a second portion of the upper edge of the pouches to the flap.

19. A reversible pair of pants in accordance with claim 14 wherein the pocket flap is secured to the pants along a portion of a waistband of the pants and along a portion of the side seam of the pants.

20. A reversible pair of pants in accordance with claim 13 further comprising a first surface rear patch pocket and a second surface rear patch pocket, the first and second surface patch pockets being located on different halves of the rear side of the pants.

* * * * *